United States Patent [19]

Lang et al.

[11] 4,333,206

[45] Jun. 8, 1982

[54] NESTED HINGE MEMBERS WITH SPRING ARM CATCH

[75] Inventors: Richard D. Lang, Chittenango; Theodore S. Bolton, Liverpool both of N.Y.

[73] Assignee: Carrier Corporation, Syracuse, N.Y.

[21] Appl. No.: 151,038

[22] Filed: May 19, 1980

[51] Int. Cl.[3] ..... E05D 1/04

[52] U.S. Cl. ..... 16/335; 16/356; 16/364

[58] Field of Search ..... 16/178, 142, 191

[56] References Cited

U.S. PATENT DOCUMENTS

| | | | |
|---|---|---|---|
| 731,138 | 6/1903 | Stearns | 16/178 |
| 1,748,733 | 2/1930 | Schamberg | 16/178 |
| 3,718,943 | 3/1973 | Bustin | 16/178 |

FOREIGN PATENT DOCUMENTS

| | | | |
|---|---|---|---|
| 524228 | 8/1940 | United Kingdom | 16/178 |

*Primary Examiner*—Werner H. Schroeder
*Assistant Examiner*—Andrew M. Falik
*Attorney, Agent, or Firm*—J. Raymond Curtin; Robert P. Hayter

[57] ABSTRACT

Apparatus for mounting a door for pivotal movement in an air conditioning unit. This door has as a portion thereof a pivot assembly having a series of contact surfaces which engage a series of surfaces of a top support so that the door may be rotated relative to the top support. The entire mechanism is formed of two components which, when assembled, provide a rotational mechanism hidden from view. An over center pressure applying means to secure the door in the fully open position is additionally disclosed.

4 Claims, 4 Drawing Figures

NESTED HINGE MEMBERS WITH SPRING ARM CATCH

BACKGROUND OF THE INVENTION

1. Field of the Invention

This invention relates internal to a mechanism for pivotally securing a door. More specifically, this invention relates to a combination support and pivot mechanism for mounting a door in an air conditioning unit.

2. Prior Art

Air conditioning units which are commonly used for residential and similar applications generally are contained within a single casing. This casing is usually divided into an evaporator section and a condenser section, each section having its own fan to circulate air therein. An air conditioning unit is normally mounted with the evaporator section communicating with room air to be conditioned and the condenser section communicating with external air such as outside air. Refrigerant flows through a self-contained refrigerant circuit removing heat from the room air and discharging heat to the outside air.

A unit mounted with a portion extending into a room of an enclosure to be conditioned need be both pleasing in appearance and functional in purpose. It is additionally common to have controls to operate the unit available to the occupant of the enclosure. To maintain the pleasing appearance, often these controls are covered with a door such that they are hidden from view when not in use. The provision of the door may also provide for certain operational considerations such as the preventing of children from manipulating the controls inadvertently.

The provision of such a door requires that it be sturdy and able to take abuse while maintaining its proper appearance. Additionally, the door must be arranged such that it is accessible to the operator and does not present a hazard when placed in various positions. It is additionally helpful to have the door maintained in the open position when the operator desires to have it placed in that position.

SUMMARY OF THE INVENTION

An object of the present invention is to provide an air conditioning unit with an improved mounting mechanism for securing the door for pivotal movement therein.

It is a further object of the present invention to provide a combination support structure and door structure which may be interlocked for safe and reliable relative movement therebetween.

It is another object of the present invention to provide a door mechanism which allows the door to be secured in a fully open position.

It is a further object of the present invention to provide an apparatus as above which is economical to manufacture and maintain, simple in construction, easy to operate and compact in size and number of parts.

Other objects will be apparent from the description to follow and from the appended claims.

The preceding objects are achieved according to the preferred embodiment of the invention by the provision of a support assembly having a curvilinear rotating support providing both an inner guide surface and an outer guide surface, a planar support and a sliding support defining a sliding surface. A pivot assembly formed as an integral part of the door includes a pivot cylinder for engaging the inner guide surface of the rotating support, a rotating portion having an outer surface for engaging the sliding surface of the slide support and an inner guide surface for engaging the outer guide surface of the rotating support such that this group of surfaces may cooperate to provide for pivotal movement of the door relative to the support.

DESCRIPTION OF THE PREFERRED EMBODIMENT

The embodiment of the invention described below is adapted for use as a control door in a self-contained air conditioning unit of the so called packaged terminal air conditioner type. It is to be understood this invention has like applicability to control doors of other types of air conditioning equipment, to all types of doors of other types of air conditioning equipment and in general to door mounting mechanisms.

Figure 1:
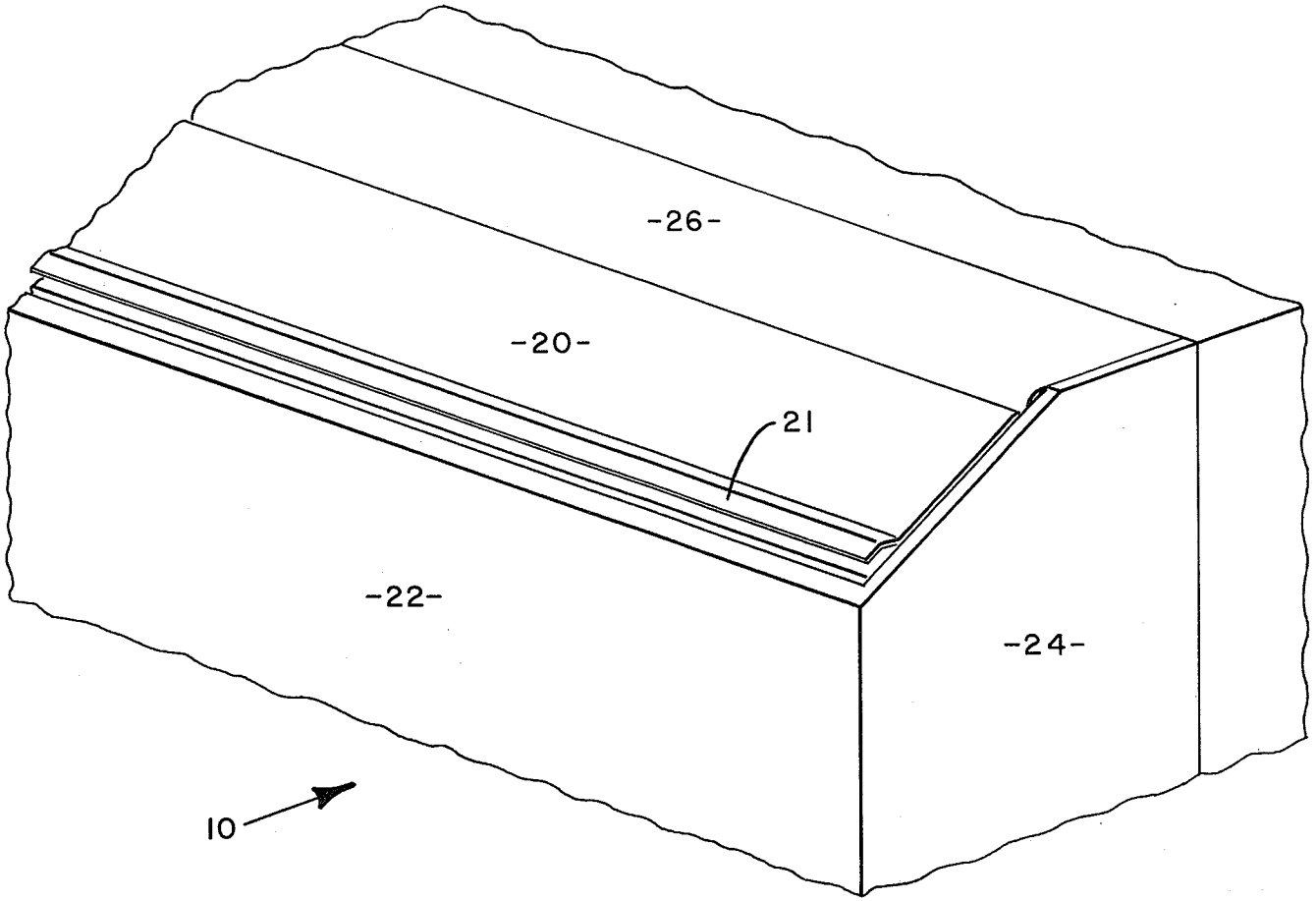
FIG. 1 is a partial perspective view of a packaged terminal air conditioning unit showing a door mounted to cover a portion of the unit.

Referring now to the drawings, FIG. 1 shows a perspective view of a portion of a packaged terminal air conditioning unit having a cover 20. This cover 20 is mounted relative to top 26 for pivotal movement therebetween. From FIG. 1 it is apparent that the rotating mechanism is entirely hidden from view and the observer merely sees the two components. Cover 20 has lip 21 extending upwardly therefrom such that the operator may easily engage the lip to open the cover. Front 22 and side 24 of the unit are also shown. To further aid in the overall appearance of the unit cover 20 and top 26 may be single extruded components extending the length of the respective portions of the unit. Cover 20 usually extends the length of the control area that is hidden from view whereas top 26 may extend the entire length of the unit.

Figure 2:
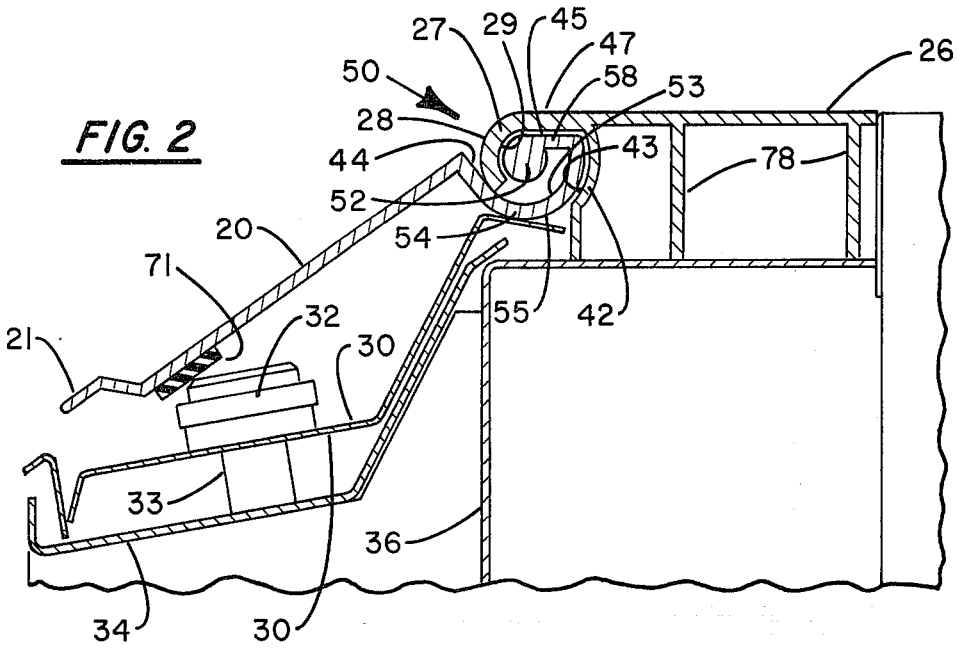
FIG. 2 is a cross-sectional view of the door mounting mechanism with the door in the fully closed position.
Figure 3:
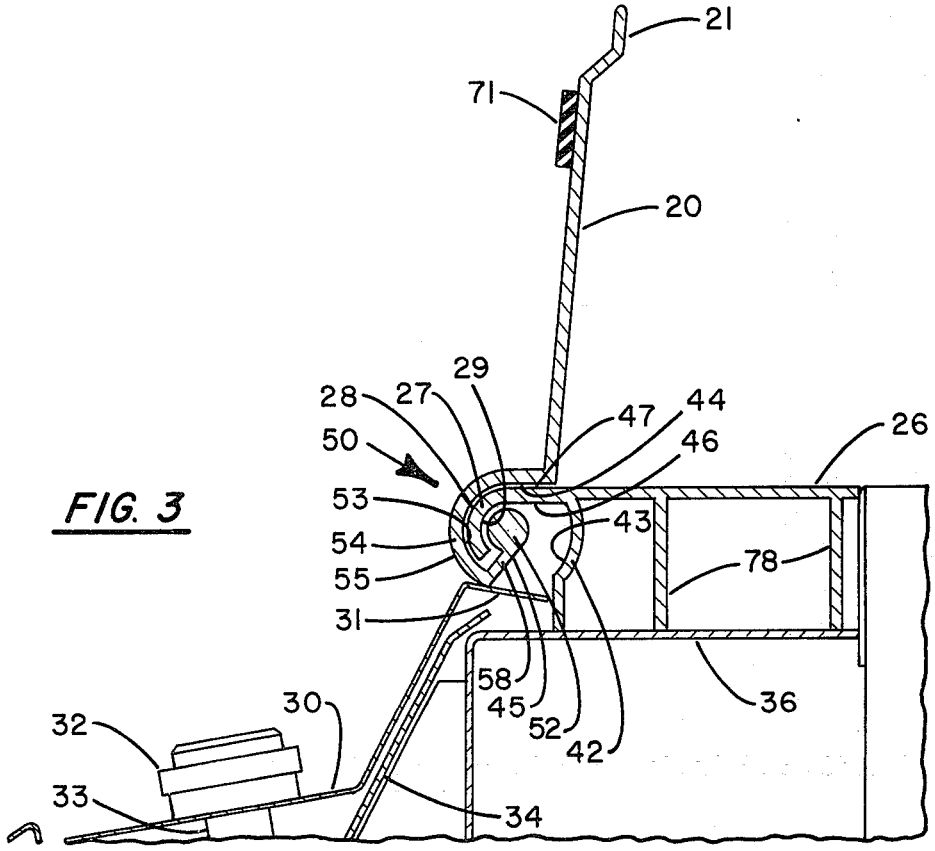
FIG. 3 is a view of the door mounting mechanism identical to FIG. 2 with the door in the fully open position.

Referring now to FIGS. 2 and 3, the door mounting mechanism may be seen in detail as well as the door in the fully closed and fully open positions. A top 26 and cover 20 are shown in their relative positions similar to that of FIG. 1. It can be seen that top 26 has numerous designated components to aid in the explanation of the configuration of top 26. Top 26 has a top rotating support 27 defining a top rotating support outer guide surface 28 and the top rotating support inner guide surface 29. Connected to the top rotating support is a planar portion having a top support surface 47 and a bottom support surface 46. Connected to this planar portion is a top slide support 42 having a slide support surface 43 mounted on the side thereof adjacent the rotating support. Top supports 28 are likewise shown to support the planar portion of top 26 together with slide support 43. Cover 20 has a lip portion 21 to aid the operator in opening the unit and a central portion connecting the lip portion to pivot portion 50 of cover 20. Rubber snubber 71 is mounted to cover 20 to engage control knob 32.

This pivot portion of the cover includes cover rotating portion 54, pivot cylinder connector 58 and pivot cylinder 52. The pivot cylinder is cylindrical in configuration and the axis of rotation of the door is located at the center thereof. The exterior surface of the pivot cylinder is sized to mate with the top rotating support inner guide surface. The cover rotating portion 54 has an inner surface 53 which engages the top rotating support outer guide surface and an outer surface 55 which may engage slide surface 43.

Control knob 32 connected to control shaft 33 are mounted within the control area of the unit. Escutcheon 30 is provided in the control area to appropriately define the control mechanism to the operator. Escutcheon 30 has an escutcheon pressure portion 31 which contacts the outer surface of the rotating portion 54 of the cover. This escutcheon may be formed from a resilient material and may act to apply a small force against the outer surface of the rotating portion of the cover. Control plate 34 and internal wall 36 are shown to designate a portion of the remainder of the structure of the unit.

As can be seen in FIG. 2, the door is in the fully closed position. In this position, the pivot cylinder contacts inner guide surface 29 of the top rotating support, a portion of the outer surface of the cover rotating portion 54 engages slide surface 43 of the slide support and a portion of the inner surface 53 of the cover rotating portion engages a portion of outer guide surfaces 28 of the top rotating support. Additionally, a portion of the pivot cylinder connector referenced as contact surface 45 engages the bottom surface 46 of the planar support or top 26. The engagement of the pivot cylinder contact surface with the planar support serves to prevent further rotation in a counterclockwise direction and maintains the cover in the position shown. This position having the cover lip portion spaced from escutcheon 30 enables the operator to easily grasp the cover.

In FIG. 3, it can be seen that the door is in the fully open position. In this position, the pivot cylinder again engages the inner guide surface 29 of the top rotating support, the inner surface 53 of cover rotating portion 54 engages the outer guide surface 28 of top rotating support 27 and a portion of that inner guide surface designated as rotating portion contact surface 44 engages the top support surface 47 of top 26 to limit rotation in a clockwise direction. Additionally, it can be seen that escutcheon pressure portion 31 in this position acts to apply an upward pressure to the cover rotating portion which further acts to maintain the cover in the position shown. Since the area of the rotating portion 54 which the escutcheon pressure portion 31 contacts is offset from the axis of rotation when the cover is in the fully open position, this pressure acts to maintain the cover in the furthest possible clockwise position which is the position shown with the top support surface engaging the planar support.

Figure 4:
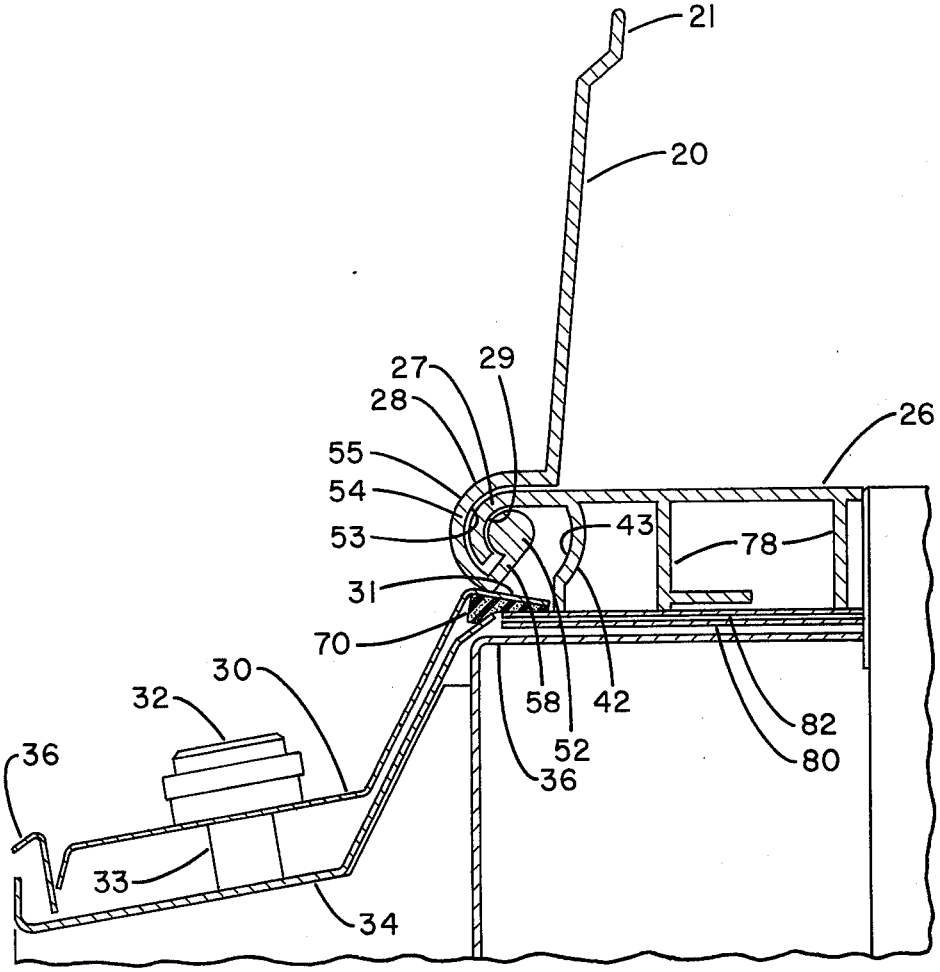
FIG. 4 is a view of a separate embodiment of the door mounting mechanism with the door in the fully open position.

FIG. 4 is identical to FIG. 3 in showing the door in the fully open position. However, FIG. 4 additionally shows a resilient material 70 and additional inner walls 80 and 82. Resilient material 70 is placed between escutcheon pressure portion 31 and control plate 34 as well as walls 80 and 82 such that an additional upward force is applied by escutcheon pressure portion 31 to cover rotating portion 54. Resilient material 70 may be a compressed foam or other material which acts to create an expansion force between control plate 34 which is fixed and escutcheon portion 31 which is capable of moving upwardly. The addition of this resilient material further acts to increase the internal spring force of the escutcheon pressure portion to maintain the door in the open position.

Pivot cylinder connector 58 is of such a length that when the cover is in the fully closed position pivot cylinder 52 engages inner guide surface 29 of the top rotating support and outer surface 55 of the rotating portion engages slide surface 43 of the slide support to maintain the cover (door) and the top engaged. As the cover is rotated in a clockwise direction, the inner surface 53 of the cover rotating portion engages the outer guide surface 28 of the top rotating support and that engagement together with the pivot cylinder coacting with the inner guide surface act to maintain the pivotal relationship. Since the outer surface 55 of the rotating portion becomes disengaged with slide surface 43 of the slide support after a predetermined amount of rotation, it is solely the engagement between the pivot cylinder and the inner guide surface and inner surface 53 of the rotating portion with outer guide surface 28 of the rotating support which maintain the door and top in position during the continuing rotation to the fully open position.

The design of this door mounting mechanism requires that the door be assembled to the top by sliding the components together. The components are placed in end to end relationship and then slidably engaged to the appropriate configuration. It can be further seen from FIGS. 2 and 3 that the appearance from above does not disclose the inner workings of the pivot mechanism and provides a smooth surface creating a pleasant appearance. This mechanism provides for rotation of the door as well as providing for stops to limit rotation of the door in each direction. The escutcheon pressure portion alone or in combination with additional resilient material may act to secure the door in a fully open position. The top and cover may be each manufactured from a single extruded component such that a neat, compact and good looking unit is provided. The utilization of only two components further serves to prevent potential assembly difficulties.

This invention has been described in detail with particular reference to a preferred embodiment thereof, but it will be understood that variations and modifications can be effected within the spirit and scope of the invention.

We claim:

1. A rotatable door mechanism for securing a door of an air conditioning unit which comprises:

a support assembly having a curvilinear rotating support defining both an inner guide surface and an outer guide surface and a slide support spaced from the rotating support, said slide support including a curvilinear slide surface;

a pivot assembly for mating with the support assembly including a rotating portion having an inner guide surface for engaging the outer guide surface of the rotating support and an outer guide surface for engaging the slide surface of the slide support and a pivot cylinder for engaging the inner guide surface of the rotating support;

a door mounted to the pivot assembly whereby the door may be rotated between positions with the various surfaces of the pivot assembly and support assembly engaging each other to provide for rotational movement therebetween; and a plate mounted to engage the outer surface of the rotating portion, said plate acting to secure the door in a predetermined position by applying a force to the rotating portion of the pivot assembly.

2. The apparatus as set forth in claim 1 and further comprising a compressed resilient material being located on the side of the plate opposite the side contacting the rotating portion to allow for additional force to be applied by the plate to the rotating portion.

3. Pivotally rotatable apparatus for securing a door for rotational movement relative to a support structure which comprises:

a support assembly connected to the support structure having a curvilinear rotating support extending from a planar support, said curvilinear rotating support extending through more than 90° of arc measured from the planar support and said rotating support defining an inner guide surface and an outer guide surface, a slide support having a curvilinear slide surface said slide support being connected to the planar support, and spaced from the rotating support;

a pivot assembly connected to the door for rotating relative to the support assembly, said pivot assembly including a pivot cylinder having its center as the rotational axis, said pivot cylinder engaging the inner guide surface of the rotating support, a rotating portion having an outer surface for engaging the slide surface of the slide support and an inner surface for engaging the outer surface of the rotating support whereby the pivot assembly may rotate about the center of the pivot cylinder while engaging various surfaces of the support assembly; and a plate mounted to engage the outer surface of the rotating portion, said plate serving when the door is in the fully open position to secure the door in that position by applying a force to the rotating portion, said force acting to maintain contact between the inner surface of the rotating portion and the planar support to secure the door in a fully open position.

4. The apparatus as set forth in claim 3 and further comprising a resilient material located between the plate and a support member, said resilient material serving to force the pressure plate against the outer surface of the rotating portion to maintain the door in the fully open position.

* * * * *